United States Patent [19]

Rydin

[11] 4,355,776

[45] Oct. 26, 1982

[54] TOY RAILROAD TRACK SWITCH ARRANGEMENT

[76] Inventor: Carl N. Rydin, 4S556 River Rd., Naperville, Ill. 60540

[21] Appl. No.: 193,138

[22] Filed: Oct. 2, 1980

[51] Int. Cl.[3] ..... B61L 5/06; B61L 11/08; E01B 7/00

[52] U.S. Cl. ..... 246/415 A; 46/1 K; 246/219

[58] Field of Search ..... 46/1 K; 104/13 D; 238/10 E, 10 F; 246/219, 231, 415 A, 415 R

[56] References Cited

U.S. PATENT DOCUMENTS

| | | | |
|---|---|---|---|
| 1,671,971 | 6/1928 | Cooper | 246/415 A X |
| 2,202,546 | 5/1940 | Bonanno | 246/219 |
| 3,126,179 | 3/1964 | Bonanno | 246/231 |
| 3,918,665 | 11/1975 | Alimanestianu et al. | 246/415 R |

*Primary Examiner*—Robert B. Reeves
*Assistant Examiner*—Howard Beltran
*Attorney, Agent, or Firm*—McWilliams, Mann & Zummer

[57] ABSTRACT

A track switch assembly for toy electrically operated railroad trains comprising a plastic base having the usual main and branch lines and switch point arrangement therefor, in which the inside rails and the power rails of the main and branch lines are interrupted and have mounted in the interruptions a main line continuity rail structure and a branch line continuity rail structure that are electrically insulated for separate energizing and that are shaped for continuous electrical energy supply as the locomotive and cars one by one pass through the switch. Energization and switching of the switch points is effected in an opposite manner using a pair of oppositely acting throw bars disposed transversely under the track and actuated by an actuation mechanism in turn actuated by oppositely acting solenoid coils energized through separate trigger circuits closed by contacts energized by the locomotive wheels, with one of the bars having a contact plate or strip to energize the continuity rail structure of the line being used for transit, and the other throw bar throwing the switch as needed. Optional manual push button operation is also provided for.

14 Claims, 11 Drawing Figures

TOY RAILROAD TRACK SWITCH ARRANGEMENT

This invention relates to a track switch assembly for use with toy or so-called model railroad trains of the electrically powered type, and more particularly, to a preassembled toy track switch assembly that is adopted for incorporation in conventional electrically powered toy railroad trackage.

Conventional toy track switch assemblies of the electrically operated train type are arranged to provide for energization of the locomotive drive motor, through its roller pick up that rides on the trackage power rail structure, by special track segments located adjacent the area of the merger of the switch main and branch lines, which typically involves brief interruption of the power supply to the locomotive and cars as the same consecutively cross the switch trackage, which results in the familiar blinking of the train lights, and sometimes momentary loss of speed of the train. Further, conventional track assembly switch actuating mechanisms for equipment of this type are bulky, limit track arrangements due to interference with train cars, and frequently do not provide for both automatic operation and the now popular push button manual operation.

A principal object of this invention is to provide a toy track switch assembly for incorporation in toy or model railroad trackage of the electrically operated train type, wherein the trackage at the merging of the main and branch lines includes a continuity rail structure in each line for insuring smooth passage of the locomotive and car electrical contact or pickup rollers across the critical areas of the switch, as well as insure uninterrupted electrical power supply thereto.

Another principal object of the invention is to provide a toy track switch assembly of the type indicated wherein the switch assembly for one direction of movement through the switch along the main or branch lines, provides for automatic electrically actuated switching of the switch points, and energization of the continuity structures that is appropriate for the direction of movement through the switch.

Yet another principal object of the invention is to provide a toy track switch assembly of the type indicated in which a low profile actuation assembly is incorporated therein that is operable to both change the switch points and energize the appropriate continuity rail structure by way of an effectively operating linkage and articulation assembly, and a circuit arrangement that is operable automatically for train movement in one direction through the switch, and by way of push button control manual operation for the other direction.

Another important object of the invention is to provide a structural arrangement for toy track switch assemblies in which the trackage is applied to a planar molded plastic base shaped for ready application thereto of the track rails, the circuiting actuation linkage, and the operating mechanism therefor, which accommodates ready and convenient assembly of the switch components and provides a resulting product that avoids upstanding obstructions that permits flexibility in providing for adjacent track as well as incorporation in a track layout.

Yet further objects of the invention are to provide a toy switch assembly of the type indicated that is inexpensive of manufacture, convenient to install and use, and long lived in operation.

In accordance with the invention, a track switch assembly for toy electrically operated railroad trains is provided comprising a base formed from a suitable bakelite composition or the like, and having mounted on same the usual main and branch lines and switch point arrangement therefor, in which the inside rails and the power rails of the main and branch lines are interrupted at the areas of their merger, and have mounted in the interruptions in addition to the usual frog a main line continuity rail structure and a branch line continuity rail structure that are electrically insulated for separate energization, and that are shaped to provide for continuous electrical energy supply as the train locomotive and cars pass one by one through the switch. Energization of the respective continuity rail structure and switching of the switch points is effected in an opposite manner using a pair of oppositely acting throw bars disposed under the track in transverse relation thereto and actuated by an actuation mechanism that is in turn actuated by oppositely acting solenoid coils energized for one direction of movement through the switch by separate trigger circuits closed by contacts engaged by the locomotive wheels, with one of the throw bars being charged to energize the continuity rail structure of the line being used, and the other throw bar throwing the switch as needed. The electrical circuiting involved is also arranged to provide for manual push button operation for movement of the train through the switch in the opposite direction of movement.

Other objects, uses, and advantages will be obvious or become apparent from a consideration of the following detailed description and the application drawings in which like reference numerals indicate like parts throughout the several views.

Figure 5:
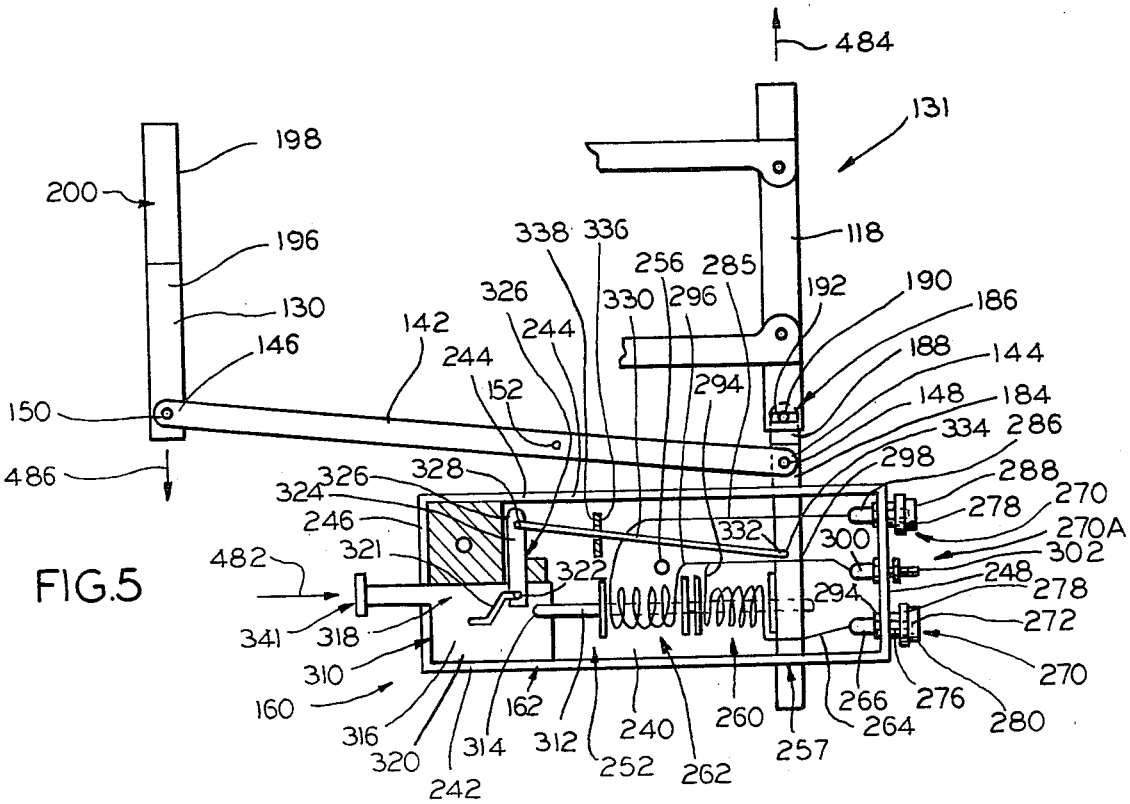
Figure 6:
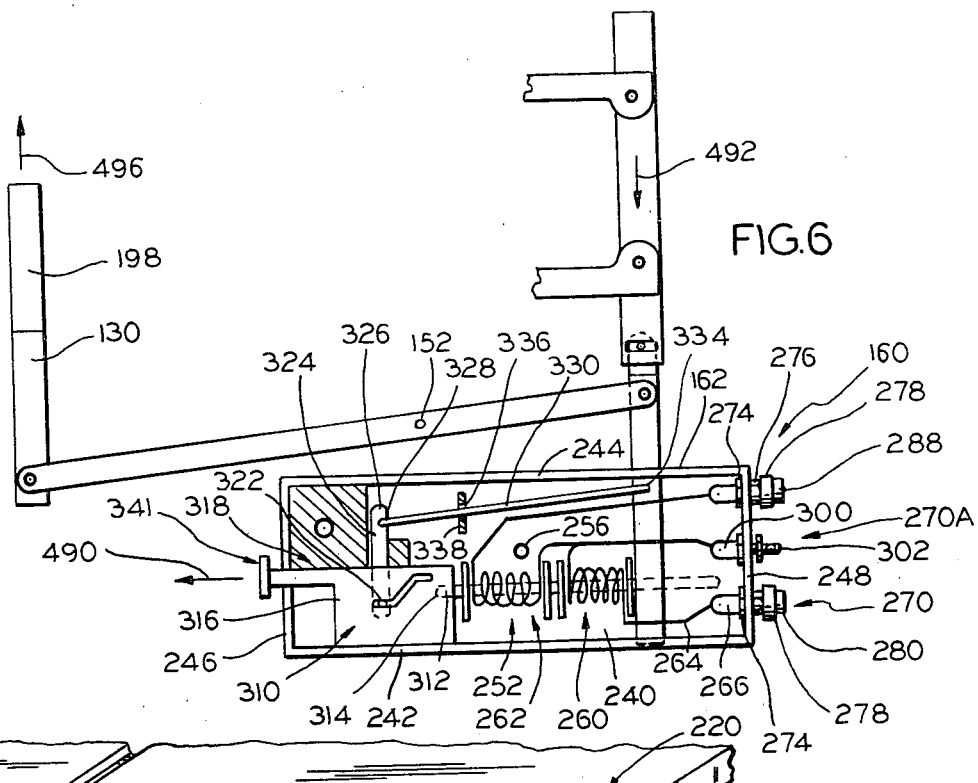
Figure 7:
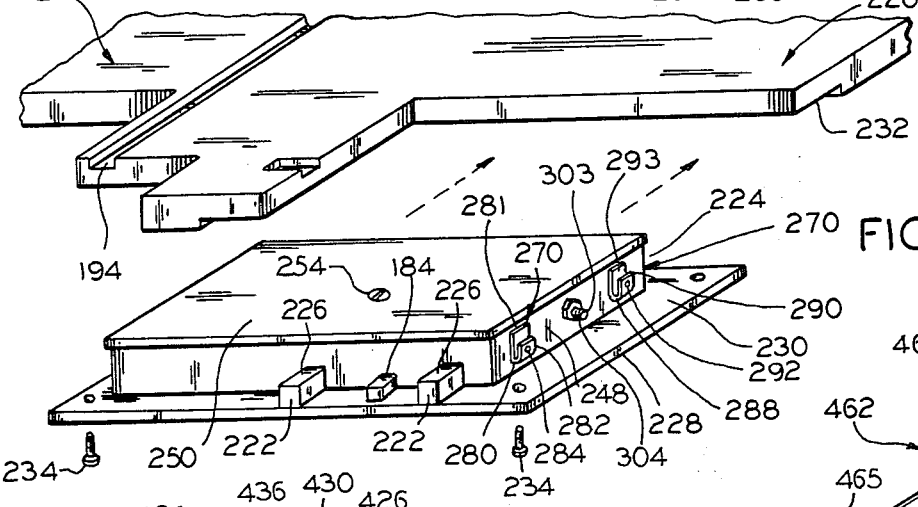
Figure 9:
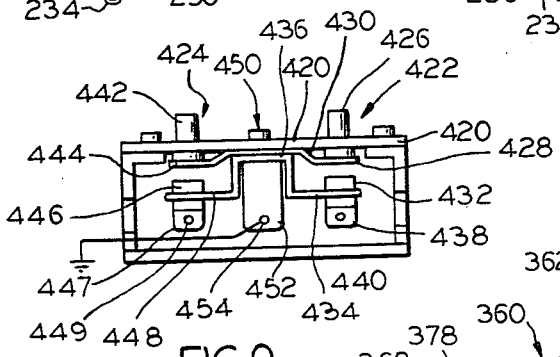
Figure 10:
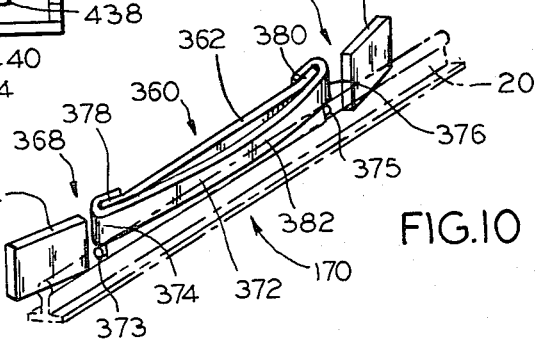
Figure 8:
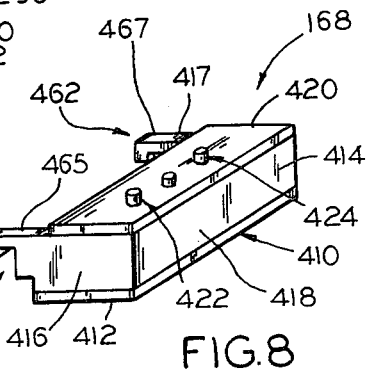
Figure 11:
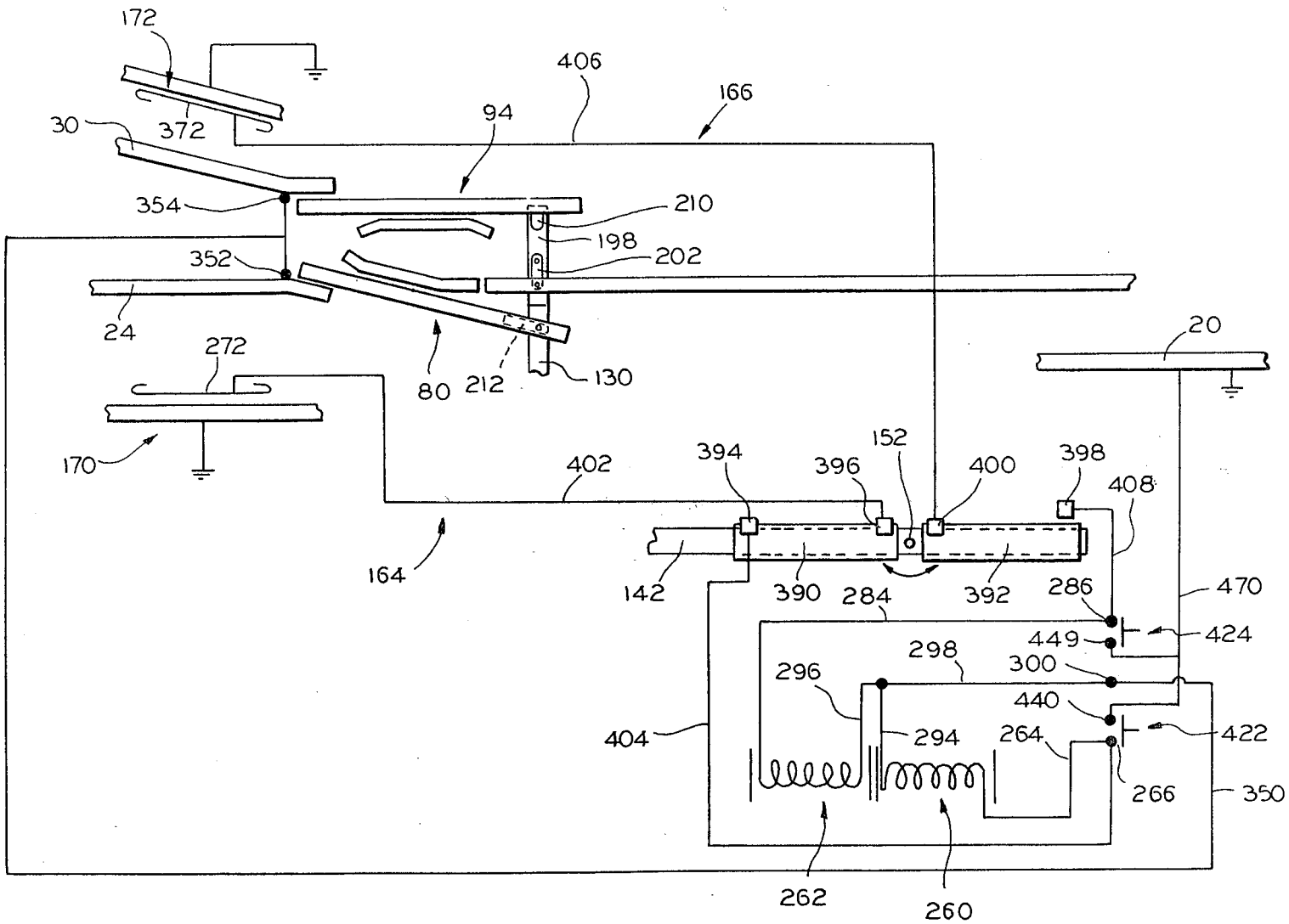

FIGS. 5 and 6 diagrammatically illustrate the oppositely acting throw bars of the switch assembly and their manner of actuation;

FIG. 7 is a diagrammatical largely block diagram perspective view of the throw bar actuation assembly housing and associated structures and indicating their manner of application to the switch base;

FIG. 8 is a diagrammatic perspective view illustrating a snap on push button equipped control assembly that is removably secured to the switch actuation assembly for providing the push button manual operation feature of the invention;

FIG. 9 is a side elevational view of the subassembly shown in FIG. 8, taken from the left hand side of same;

FIG. 10 is a diagrammatic perspective view illustrating on an enlarged scale one of the guard rail electrical contact devices of the invention that are provided to effect energization of the switch assembly throw bars; and FIG. 11 is a diagrammatically illustrated wiring diagram arrangement illustrating the electrical aspects of the switch construction of this invention.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Figure 1:
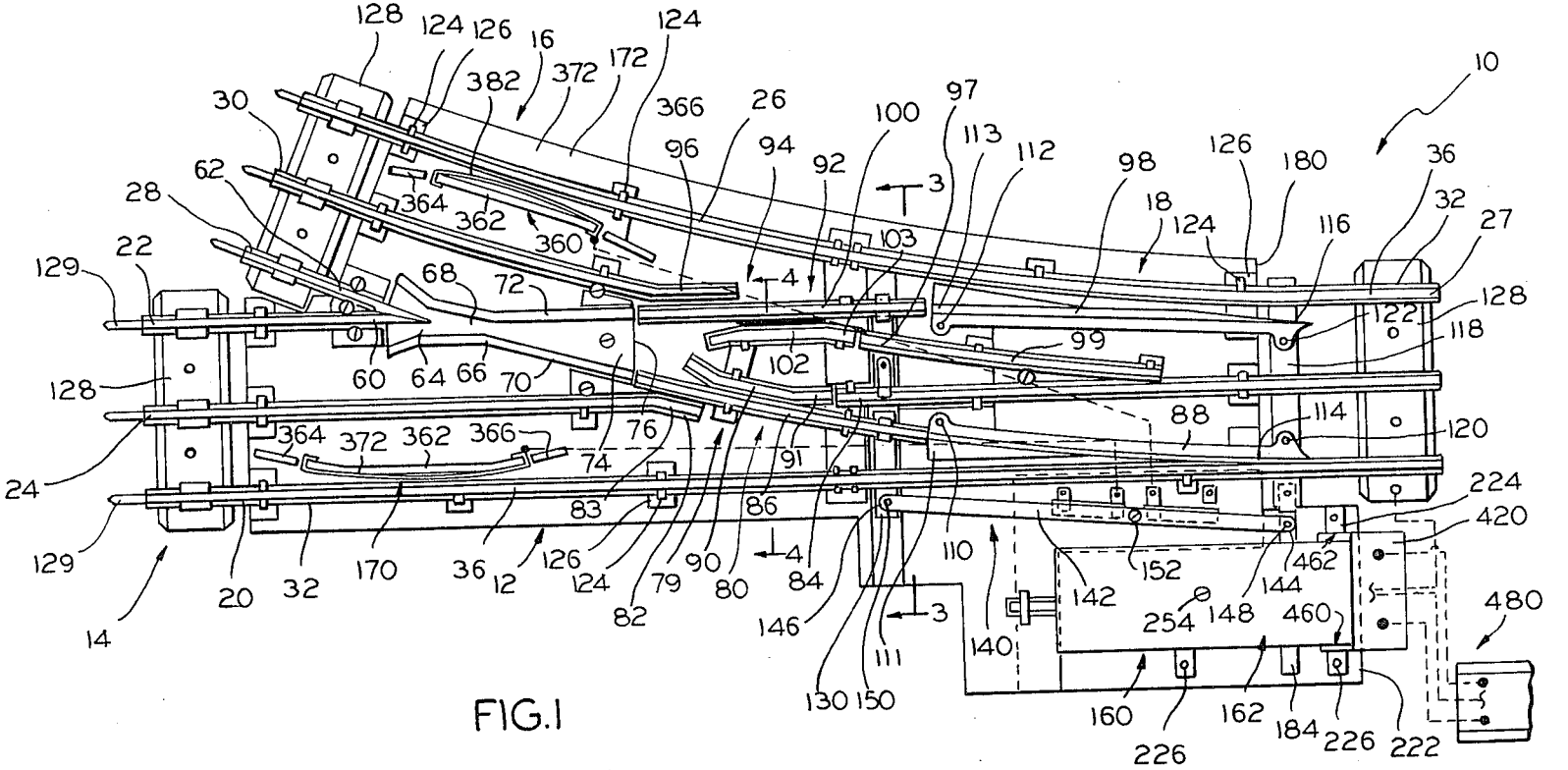
FIG. 1 is a top plan view illustrating a preferred embodiment of the toy track switch assembly of the invention, as assembled for incorporation in a toy train railroad track that is of the electrically operated type and of the same size.
Figure 2:
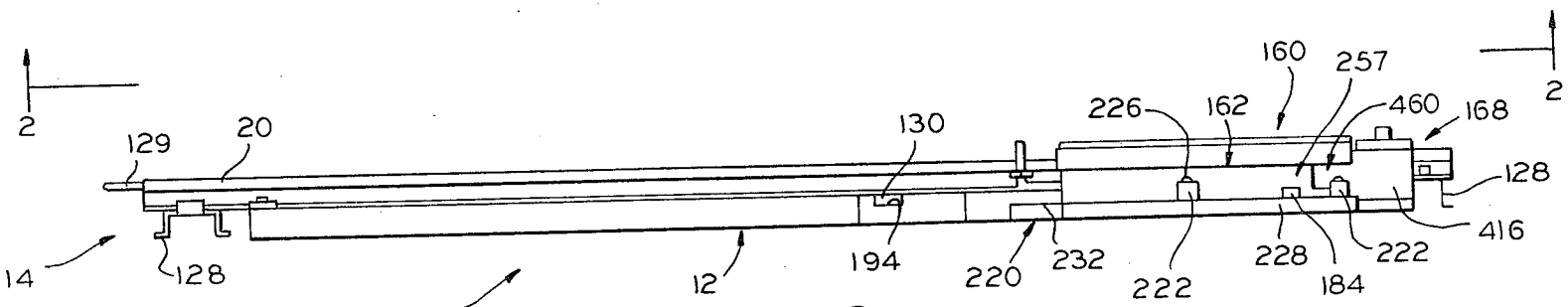
FIG. 2 is a side elevational view of the assembly shown in FIG. 1, taken substantially along line 2—2 of FIG. 1.

Reference numeral 10 of FIGS. 1 and 2 generally indicates a preferred embodiment of the invention comprising a relatively flat, planar base 12 formed from a suitable plastic material, such as a suitable bakelite composition, having the switch assembly basic components mounted on same to provide a main line 14, and a branch line 16 to which trains proceeding from the right to the left side of FIG. 1 along main line 14 may be switched employing switch mechanism 18.

The main line comprises the usual outside rail 20, inside rail 22, and the usual center located power rail 24.

The branch line 16 comprises outside rail 26 that is curved for smooth transmittal between the rectilinear inside rail of the main line track section to be conventionally secured thereto at assembly end 27, an inside rail 28, and the usual powered center rail 30.

Figure 3:
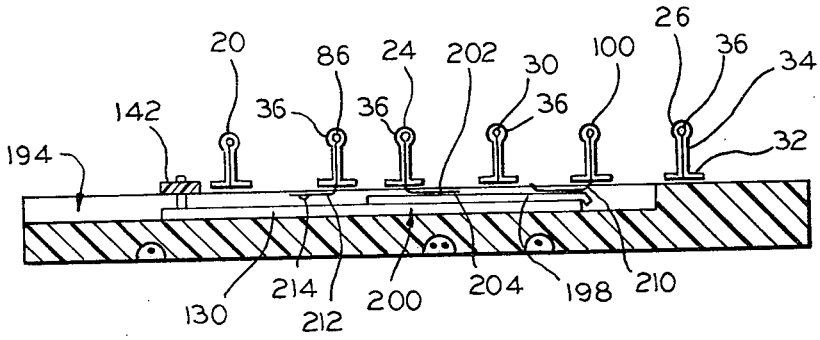
FIG. 3 is a vertical sectional view through the switch assembly taken substantially along line 3—3 of FIG. 1.
Figure 4:
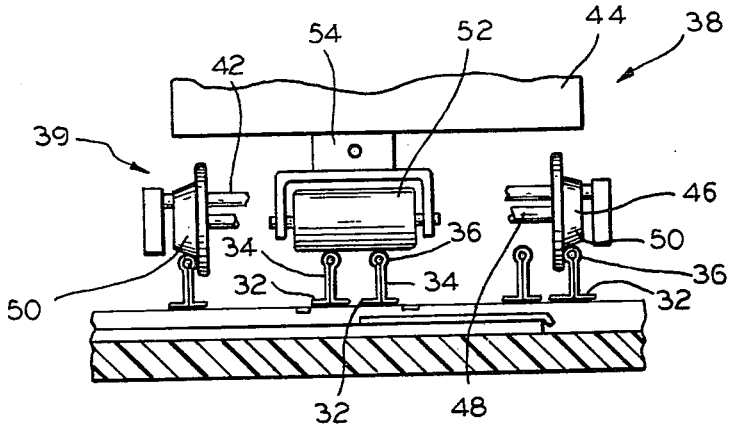
FIG. 4 is a fragmental vertical sectional view taken substantially along line 4—4 of FIG. 1 and through the continuity rail structures of the switch assembly and showing also in largely block diagram form familiar parts of an electrically operated railroad vehicle passing over the continuity rail structures of the invention moving along the main line of the track.

These rails have the familiar cross-sectional configuration for toy electric trains that is diagrammatically illustrated in FIGS. 3 and 4 and define the usual base flange 32, vertical flange 34, and rail head 36 on which the car wheels ride in the manner diagrammatically illustrated in FIG. 4. As shown in FIG. 4, the locomotive or other car generally indicated by reference numeral 38 includes for each truck 39 a bolster 42 suitably pivotally connected to the car body 44 in any conventional manner, having its ends suitably connected to side frames 46 journaling a pair of axles 48 that ride on the usual flanged wheels 50. As is well known in the art, the locomotives and cars of electrically operated toy railroad trains are each equipped with an electrical energy pick up roller 52 suitably journaled on the bottom of the car on the end of diagrammatically illustrated leaf spring 54 that is suitably electrically connected with the electrically operated devices carried by the car for electrical operation of same by way of electrical energy flow through the pick up roller that is returned to ground through the wheels 50 and the track side rails that are grounded in any conventional manner.

The railroad vehicle 38 illustrated in FIG. 4 that is shown in largely block diagram form is merely intended to illustrate the general nature of this type of equipment rather than to illustrate any specific kind of locomotive or car.

Toy track switch assemblies of the type involved structurally are concerned with merging branch and main lines and for purposes of achieving the switching arrangement involved, the main line inside rail 22 and center rail 24, and the branch line inside rail 28, and its center rail 30 are interrupted. The main and branch line inside rails 22 and 28 merge at their respective point pieces 60 and 62 that are at the heel 64 of conventional frog 66 defining the usual throat 68 and wing rails 70 and 72 that in turn define the frog mouth at its toe 76. The frog wing rail 72 is aligned with the main line inside rail 22 while the frog wing rail 70 is aligned with the branch line inside rail 28.

In accordance with the invention, at the main line center rail interruption 79 a main line center rail continuity rail structure 80 is provided that is interposed between the interrupted end portions 82 and 84 of the main line center rail 24 and in overlapping relation thereto that comprises a transfer rail 86 that is aligned with the branch line inside rail 28 and extends between the frog toe 76 and the switch point 88 of the switch 18 that is to lead into optional tangent relation with the main line outside rail 20. Operatively associated with the transfer rail 86 is guard rail 90, with the rails 80 and 90 being electrically isolated or insulated from the switch assembly power rails for separate but joint energization of same, as will be disclosed hereinafter. The interrupted portion 82 of rail 24 is shaped to define end portion 83 that parallels rail 86 and has the portion of its base flange 32 on the rail 86 side of same removed to avoid contact with rail 86. The end portion 91 of guard rail 90 is aligned with tne end portion 84 of main line center rail 24.

Further, at the interruption 92 of the branch line center rail 30 a branch line center rail continuity rail structure 94 is interposed between the branch line center rail end portion 96 and the switch point 98 of the switch 18 and in overlapping relation thereto that is to be optionally placed in tangent relation with the branch line outside rail 26. The continuity rail structure 94 comprises transfer rail 100 and guard rail 102, with the transfer rail 100 being aligned with the main line inside rail 22 and switch point 98, and extending between the frog toe 96 and the switch point 98. As is the case with the continuity rail structure 80, the branch line continuity rail structure transfer rail 100 and guard rail 102 are electrically isolated or insulated from the electrically charged center rails 24 and 30 of the switch assembly for separate but joint energization of same. The branch line center rail end portion 96 is shaped to parallel rail 100 and has its base flange 32 on the rail 100 side of same removed to avoid contact with rail 100. The end portion 103 of guard rail 102 is aligned with end portion 97 of the branch line center rail segment 99 formed by interruption 92.

The switch points 88 and 98 are of conventional configuration, with the switch point 88 being pivotally mounted on base 12 by suitable pivot pin 110, and with switch point 98 being similarly suitably pivotally connected to the base 12 by suitable pivot pin 112. The indicated pivotal mountings of the switch points 88 and 98 are at their respective blunt ends 111 and 113, and their pointed ends 114 and 116 are suitably pivotally connected to throw bar 118 by the respective pivot pins 120 and 122.

The basic track rail components illustrated are held in position on the base 12 in any suitable manner, as by providing the base 12 with suitable mounting lugs 124 that are force fitted against the base flanges of the respective track rail segments involved. In the form shown, the lugs 124 are centered on planar raised platform sections 126 of the base that are somewhat elevated above the top of the base for convenience of application of the track rails and smooth operation of the switch. The main and branch line rails at each end of the switch assembly are secured to the usual and familiar metallic cross tie 128, with the electrically charged rails being suitably insulated therefrom, as is conventional. The rails heads 36 are tubular to receive the usual contact pins 129 applied to alternate ends of the track rails.

Further in accordance with the invention, the throw bar 118 of the switch 18 is incorporated in an actuation linkage 131 and includes a second throw bar 130 that parallels the switch point actuation throw bar 118, with both such bars being disposed transversely of the main line track, as indicated in FIG. 1. The throw bar 130 is equipped to alternately charge the main line continuity rail structure 80 or the branch line continuity structure 94 in a sequence consistent with the alternate positioning of the switch points 88 and 98. Pursuant to this arrangement, when the switch 18 has the rail points 88 and 98 positioned for train transfer from the branch line to the main line, the branch line continuity rail structure 94 will be energized, while when the switch is positioned for passage of the train through the switch from the left to the right along the main line 14, the main line continuity rail structure 80 will be energized.

Further in accordance with the invention, the opposite movement of the throw bars 118 and 130 that is to be provided in accordance with the invention is achieved by integrating them into said actuation linkage 131 that includes a cross lever 142 having its opposite ends 144 and 146 pivotally connected to the respective throw bars as at 148 and 150, respectively, with the cross lever 142 being pivotally connected to the base 12 as at 152.

The throw bar 118, in addition, is articulated with actuation mechanism or machine 160 housed in a low profile housing 162 that is removably secured to the base 12 which is of the double oppositely acting solenoid type diagrammatically illustrated in FIGS. 5 and 6 and energized, in accordance with the illustrated arrangement, for movement through the switch assembly 10 along either the main line 14 or branch line 16, from the left to the right of FIG. 1, by way of the respective trigger circuits 164 or 166 that are illustrated in FIG. 11, or by way of the push button actuation subassembly 168 that is operatively connected to the mechanism or machine 160, where movement of the train is in the opposite direction through the switch assembly 10.

For this purpose, the main line 14 is equipped with a guard rail arrangement 170 that forms a part of the trigger circuit 164 while the branch line 16 is equipped with a guard rail arrangement 172 that forms a part of the trigger circuit 166. The arrangement is such that as the train moves from the left to the right down either the main line 14 or branch line 16, the trigger circuits 164 and 166 that is appropriate for correct positioning of the rail points 88 and 98 will be closed to actuate the actuation linkage 131 as needed to correctly position the switch points automatically for smooth train locomotive and cars passing through the switch assembly. The continuity rail structures 80 and 94 are charged in the correct sequence of alternation to the positioning of the switch points 88 and 98 for maintaining full contact of the locomotive and car pick up rollers with electrically charged portions of the track for continuous and uninterrupted power across the power track rail interruptions. On the other hand, the push button subassembly 168 may be operated in a similar manner to properly position the indicated components involved for passage of the train from the right to the left of the truck assembly 10, that is for passage either all on the main line track assembly, or from the main line onto the branch line and thus through the track assembly, with the same type of continuous and uninterrupted power pick up by the locomotive and car pick up rollers over the power track rail interruptions.

SPECIFIC DESCRIPTION

The transfer rails 86 and 100 and the guard rails 90 and 102, of the respective continuity rail structures, are short sections of track rail of the same type as the rails employed for the main line and branch line side and center rails, and are mounted in position in a similar manner. The transfer rail 86 and the guard rail 90 of the continuity rail structure 80 are electrically connected, by being mounted in physical contact with each other at their base flanges. Similarly, the transfer rail 100 and the guard rail 102 therefor of the continuity rail structure 94 are in electrical contact relation, as by having their base flanges in contact. However, as indicated, these continuity rail structures 80 and 94 are electrically isolated from each other and from the other track power rails, for alternate energization using the actuation machine or mechanism 160.

The throw bar 118 in the form illustrated is disposed adjacent the end 180 of base 12 and is connected in inline relation to an extension segment 184 (see FIGS. 5 and 6) of same by a pin and slot type connection indicated at 186 in FIGS. 5 and 6 in which a connecting segment 188 that is bonded to the underside of the extension 184 has an upstanding pin 190 received in the operating slot 192 of throw bar 118. The cross lever 142 is actually pivotally connected by the pin 148 to extension 184 which is operably connected with the actuation machine or machanism 160 in the manner diagrammatically illustrated in FIGS. 5 and 6 and that will be specifically referred to hereinafter.

The throw bar 130 is disposed in an operating slot or slideway 194 of the base 12 (see FIGS. 1, 2 and 7) so as to be disposed in underlying relation to the switch assembly track rails and cooperates therewith, in the manner indicated in FIG. 3. The throw bar 130 has suitably bonded to its upper side 196 a length of copper stripping 198 forming a slide contact 200 which is electrically charged by a copper strip 202 connected to the main line center rail 24 in the manner suggested in FIG. 3, having a contact 204 in sliding contact with the throw bar contact strip 198. The throw bar 130 is shifted to have its contact strip 198 in contact with contact strip 210 that is suitably secured to the branch line continuity rail structure transfer rail 100, or alternately, a similar contact strip 212, suitably secured to the main line continuity rail structure transfer rail 86, and specifically contact 214 or strip 212.

In the form shown, the contact strips 202, 210 and 212 are mounted between the two side sections of the rails that conventionally form the rail base flange and vertical flange struture. The contact 204 of the strip 204 is in continuous engagement with contact strip 198, while the contact strip 210 is arced and downwardly biased for good electrical contact engagement with the strip 198 when the latter is shifted thereagainst. Similarly, contact strip 212 is arced for similar engagement with the strip 198 when the latter is shifted thereagainst and in addition is provided with contact 214 for firm electrical engagement therewith.

The throw bars 118 and 130, throw bar extension 184 and its connection segment 188, and cross member 142 may be formed from a suitable plastic material, such as the aforementioned bakelite.

Referring now to the actuation mechanism or machine 160, its housing 162 is of generally planar or flat parallelepiped low profile configuration that is adapted to be received in an internal mounting corner 220 defined by the base 12 (see FIG. 7), in substantial coplanar relation thereto, as indicated by FIG. 2. For this purpose, the housing 162 is equipped with spaced integral lugs 222 on the outside edge of same and a similar integral lug 224 on the inside edge of same adapted to receive suitable mounting screws 226 for securing same to planar base sheet 228 that is proportioned to define outwardly extending edge portion 230 thereabout that receives appropriately located mounting screws 234 for releasably securing the mechanism or machine 160 to the base 12, and specifically with the base 228 received in the complementarily formed right angled recess 232 (see FIGS. 1 and 7) defined by the underside of the base 12 for this purpose.

The actuation mechanism or machine 160 is per se a commercially available device and its internal components, which include the throw bar extension section 184, are illustrated only diagrammatically, primarily for completeness of disclosure. The device 160 is a product available from Lehmann Company of Nurnberg, West Germany.

The housing 162 is of molded one piece construction including bottom wall 240, upstanding side walls 242 and 244 and their respective lugs 222 and 224, and upstanding end walls 246 and 248; a removable top or cover 250, that has a length and width dimension somewhat in excess of the length and width of the housing 162 that is defined by its side walls 242 and 244 and its end walls 246 and 248, is applied over the resulting chamber 252 and is held in place by a suitable single screw 254 that is applied through the cover 250 and is threaded into suitable opening 256 formed in the housing floor 240. Housing floor 240 and side walls 242 and 244 are slotted to slidably receive the slide bar extension section 184 and form a slideway 257 therefor.

Mounted in housing 160 are a pair of oppositely acting solenoid coils 260 and 262, with the solenoid coil 260 having one of its leads 264 electrically connected, as by soldering, to copper strip 266 that is in turn anchored to the container wall 248 by one of two screw and nut devices 270 that are diagrammatically illustrated in FIGS. 5, 6 and 7.

The screw and nut devices 270 (see FIGS. 5 and 6) each comprise a threaded stud 272 having a hex nut 274 applied to same on the other side of the wall 248 and a second hex nut 276 applied to same exteriorily of the wall 248 against which is seated knurlled locking nut 278. The contact leaf 266 is of right angled configuration and has its lower end, as viewed in FIGS. 5 and 6, secured to the housing wall 248 by nut 274. The nuts 276 and 278 also mount a U-shaped copper strip 280 that has one of its arms 281 interposed between the hex nut 276 and the housing wall 248, and its other outwardly disposed arm 282 bearing contact 284 (see FIG. 7).

The solenoid coil 262 has its lead 285 electrically connected, as by soldering, to angled copper strip member 286 that is of the same character as strip 266, and is secured in place by the second screw and nut fastening device 270 having the same components as the first assembly 270 described, as indicated by corresponding reference numerals of FIGS. 5, 6 and 7. The second device 270 also mounts a second U-shaped copper strip 288 in the same manner that copper strip 280 is mounted whereby the free end 290 of the strip 288 overlies the knurlled locking nut 278 and presents contact 292 for purposes that will be later made clear. The other end 293 of strip 288 is clamped to housing wall 248 by nut 276 of the second device 270.

The other two leads 294 and 296 of the respective solenoid coils 260 and 262 are electrically connected together to form a single lead 298 that is connected to copper strip connector 300 that is of the same type as connectors 266 and 286, with the connector 300 being mounted on the housing wall 248 by a modified screw and nut assembly 270A that comprises the two nuts 274 and 276 that lock a somewhat elongated threaded stud 302 in place with the latter also to serve as a contact 303 at its outwardly extending end portion 304, as will be later made clear.

The throw bar extension section 184 extends transversely across the housing 162, as indicated in the diagrammatic showings of FIGS. 5, 6 and 7, in its slideway 257, and is actuated on energization of the solenoid coils 260 and 262 by the linkage that is diagrammatically illustrated in FIGS. 5 and 6.

This linkage is generally designated by reference numeral 310 and comprises a thrust rod 312, formed from a suitable magnetic material, and centered within and extending longitudinally of the respective solenoid coils 260 and 262, which rod 312 is pivotally anchored at 314 to a slide member 316 of generally planar elongate configuration mounted in a slideway 318 to move with the thrust rod 312 when the respective solenoid coils 260 and 262 are actuated. The member 316 includes planar body portion 320 formed to define a substantially "Z" shaped slot 321 (of flattened configuration) that has the special shaping indicated in FIGS. 5 and 6 in which rides a stud 322 that is integral with slide arm 324 which underlies the member body portion 320 and is mounted in its own slideway 326 for shifting movement transversely of the housing 162 and thus of the path of movement of the thrust rod 312 and member 316. The slide bar 324 at its end 326 has one end 328 of spring rod 330 pivotally connected thereto, with the other end 332 of the rod being pivotally connected with the throw bar extension 184 where indicated at 334. The spring rod 326 is mounted in a narrow slot 336 formed in an upstanding flange or wall 338 that is defined by the housing floor 240 to form a fulcrum for the spring rod 330. The flange or wall 338 extends transversely of the housing 162, as indicated in FIGS. 5 and 6.

Slide member 316 of machine 160 conventionally includes the angle shaped handle structure indicated at 341 for manual operation of machine 160 when the electrical energy supply is cut off.

Referring now to the diagrammatically illustrated wiring diagram indicated in FIG. 11, the leaf contact 300 of housing 162 and its screw and nut assembly 270A are electrically connected to the source of electrical energy represented by lead 350 extending from contact 300 to suitable electrical connection to the main line and branch line center rails 24 and 30, at contacts 352 and 354. The trigger circuit 164 extends between the guard rail structure 170 and contact 266 of housing 162, as by being suitably connected to its screw and nut fastening device 270.

The guard rail 170 is diagrammatically illustrated in FIG. 10 and comprises a segmented upstanding flange structure 360 that is integral with base 12 and comprises an elongate center portion 362 and end sections 364 and 366 separated therefrom by slotting 368 and 370, respectively. The flange structure 360 is on the gauge side of the outside track rail 20 of main line 14, with the flange section 262 having applied thereto a copper strip 372 that has its opposite end portions 274 and 276 turned around the respective flange end sections 378 and 380 to mount the strip 272 in position where it is to serve as an electrical contact for the trigger circuit 164 when a locomotive moving down the main line from the left to the right of FIG. 1 reaches a point where its frontmost wheel on the main line outside rail side enters between the contact strip 273 and the outside rail 20, with the positioning between the contact 372, and specifically its face 282 and the rail head 36 of the main line outside rail 20 being such that the locomotive wheel will engage the strip 372 as it passes by the guard rail structure 170, thereby grounding trigger circuit 164 through outside rail 20. The strip 372 is of narrower width than the height of the flange section 362 and rests on studs 373 and 375 formed at the bases of the respective end sections 378 and 380, so that it will be spaced from contact with the flange of side rail 20. Strip 372 is preferably bowed toward rail 20 to have a spacing approximating 3/32's of an inch from the head 36 of rail 20 to insure that car wheels, which are usually smaller than locomotive wheels in toys of this type establish electrical contact between strip 372 and rail 20 when their flanges pass therebetween.

The trigger circuit 166 extends between the guard rail structure 172 and contact 286 of housing 162, with the guard rail structure 172 being arranged in the same manner as guard rail structure 170, but located as indicated in FIG. 1 to be adjacent the gauge side of the branch line outside rail 26. The guard rail structure 172 is composed of the same components as guard rail structure 170, as indicated by corresponding reference numerals of FIG. 1.

In accordance with the invention, the cross lever 142 is arranged to open and close the respective trigger circuits 164 and 166 in accordance with the shifting of the throw bars 118 and 130 that is affected by the mechanism or machine 162.

The cross lever 142 on either side of its pivotal mounting 152 is equipped with a pair of copper strips 390 and 392 suitably bonded thereto, with the strip 390 being positioned for sliding engagement with contacts 394 and 396, while the strip 392 is positioned for sliding engagement with contacts 398 and 400. The arrangement is such that contacts 396 and 400 are in permanent closed contact with the respective strips 390 and 392, but when the cross lever 142 is in the position of FIG. 5, the contact strip 390 is in contact with contact 394, while contact strip 392 is free of engagement with contact 398. In the position of FIG. 6, the condition is reversed, whereby the contact strip 390 is free of engagement of contact 394, but contact strip is in contact with the contact 398.

With regard to the trigger circuit 164, suitable lead 402 extends between the contact strip 372 of the guard rail structure 170 and contact 396, while the suitable lead 404 extends between the contact 394 and the contact 266 of the housing 162.

As to trigger circuit 166, suitable lead 406 extends between the contact strip 372 of guard rail structure 172, and contact 400, while suitable lead 408 extends between contact 398 and contact 286 of the housing 162.

Operably associated with the actuation mechanism or machine 160 is the aforementioned push button actuation subassembly 168, the specifics of which are diagrammatically illustrated in FIGS. 1 and 2 and 7–9.

The subassembly 168 comprises a box-like frame 410 formed from suitably secured together plastic sheet components to define a bottom panel 412, a U-shaped mid section 414 defining side panels 416 and 417, and end panel 418, and a top panel 420. The panels 412, 416, 417, 418 and 420 may be secured together in the arrangement indicated by employing a suitable adhesive.

The top panel 420, as indicated in FIG. 9, mounts a pair of push button switches 422 and 424. Push button switch 422 comprises push button member 426 that slidably extends through the panel 420 and is affixed to one end 428 of copper leaf spring member 430 and is adapted to engage contact 432 carried by a wing flange 434 of a channel shaped bracket 436 that also has secured thereto in electrical conducting relation a contact 432 and a copper leaf member 438 defining contact 440.

The push button switch 424 comprises push button member 442 slidably mounted in panel 420 and secured to the end 444 of the leaf spring 430 for closing with contact 446 carried by the other wing flange 448 of the channel shaped bracket 436, which also has secured to same in electrically conducting relation thereto copper leaf member 447 defining contact 449. The channel shaped bracket 436 and the leaf spring 430, both of which are formed from an electrically conducting material, are anchored to the top panel by suitable screw and nut assembly indicated at 450, together with copper leaf component 452 defining contact 454.

The side panels 416 and 417 of the frame section 414 are similarly shaped to define projecting arm portions 460 and 462, respectively, that are notched as indicated at 464 to be received over the lugs 222 and 224 of the actuation mechanism or machine housing 162, in the manner indicted in FIG. 2, to mount the subassembly 168 in its operating position.

In accordance with the invention, the screw and nut assemblies 270 and 270A of the housing 162, and their contacts 284, 292, and 303, and the contacts 440, 449, and 454 of the subassembly 168, are positionally related so that when the subassembly 168, having been assembled as indicated, and applied to the housing 162 in the manner indicated in FIGS. 1 and 2, will dispose the respective contacts 440, 449 and 454 in electrically conductive engagement with the respective housing contacts 284, 292. and 303, respectively. Application of the housing cover 250 to the housing 162 places same against the upper side edges 465 and 467 of the subassembly frame arm portions 460 and 462 to hold the subassembly 168 in its operating condition.

The contact 454 also requires a connection to ground, such as lead 470 shown at FIG. 11.

By making appropriate electrical connections to the indicated contacts 440, 454 and 449, the push button actuation provided by push button switches 422 and 424 may be also provided by remotely located group switch diagrammatically indicated at 480 in FIG. 1, where similarly connected switches for controlling the switching of other similar switching assembly in a toy railroad track arrangement may also be located as desired.

The electrical wiring associated with the assembly 10 may be applied to base 12 in any suitable manner; one way of accommodating the leads is suggested in FIG. 3.

OPERATION OF SWITCH ASSEMBLY

With regard to the operation of the switch assembly 10, and assuming that the assembly 10 is conditioned as indicated at FIG. 1, in which the rail points 88 and 98 are positioned for directing a train from the main line 14 to the branch line 16, the cross lever 142 will be disposed so that trigger circuit 166 is open at contact 398, while trigger circuit 164 is closed at contact 394. Throw bar 130 will be disposed to have its strip contact 198 in contact with the strip contact 210 of the branch line continuity rail structure transfer rail 100.

Assuming now that a train moves along the main line 14 into the track assembly 10 from the left hand side of FIG. 1, the first locomotive wheel on the main line outside rail side will engage the contact strip 372 of guard rail structure 170 to energize solenoid coil 260 whereby thrust rod 312 and the actuation member 316 that is secured thereto moves to the right of FIGS. 5 and 6 (as indicated by arrow 482 of FIG. 5), thereby camming by way of cam pin 322 the slide bar 324 downwardly of FIGS. 5 and 6, which swings the spring rod 330 about its fulcrum to thrust throw bar 118 upwardly, and through the cross lever 142, bring thrust rod 130 downwardly (as indicated by the respective arrows 484 and 486 of FIG. 5).

This change in the positioning of the track components changes the position of the switch points 88 and 98 to provide for through movement of the train along the main line, through the switch assembly 10. The resulting movement of the cross lever 142 closes contact 398 with its contact strip 392 to close the trigger circuit 166, while the trigger circuit 164 opens at the contact 394, thereby deenergizing solenoid coil 260 for its protection.

The throw bar 130 in its new position disposes its contact strip 198 out of contact with the contact strip 210 and into electrical contact with the contact strip 212 that is connected with the transfer rail 86 of the main line continuity rail structure 80. Thus, the transfer rail 86 and its guard rail 90 are electrically energized (the continuity rail structure 94 having been deenergized), and with the overlapping of the main line center rail interrupted portions that is provided by the continuity rail structure 80, as indicated in FIG. 1, the train locomotive pick up roller 52 is in continuous engagement with at least some portion of the electrically charged rail structure as the roller rides from the left hand center rail interrupted end portion, over the continuity rail structure 80, and onto the right hand center rail interruption portion, at this area of the track switch assembly 10. Thus, the roller 52 initially is riding on the left hand main line center rail at the left hand side of FIG. 1 and then jointly on the angled end 83 of same and the left hand end of the transfer rail 86; following the left hand center rail interrupted portion the pick up roller 52 starts riding on guard rail 90 as well transfer rail 86, and after leaving the guard rail 90 the pick up roller rides onto the right hand interruption end portion 84 of the main line center rail while continuing to ride toward the end of transfer rail 86. Thus, continuous pickup of electrical energy by the pick up roller 52 is assured until the pick up roller 52 is riding on the continuing uninterrupted center rail of the main line in the area of the switch 18, for continuous movement of the train through the switch assembly 10. Not only is the locomotive unaffected by any electrical energy disruptions or reductions, but the following cars of the train are similarly unaffected so that there is no blinking of lights or other objectionable action caused by momentary loss of electrical energy to the train or its cars.

Assuming that the train is coming down the main line in the opposite direction and the track assembly 10 is conditioned as shown in FIG. 1, push button switch 422 is actuated to energize the solenoid coil 260 and affect the same shifting of the switch assembly components that is affected by energization of trigger circuit 164.

Assuming that the switch assembly is conditioned in the manner indicated in FIG. 6 by the positioning of the throw bar 118 and 130, wherein the trigger circuit 166 is closed at contact 398 and trigger circuit 164 is open at contact 394, and assuming that a train is moving along the branch line 16 from the left of FIG. 1 into the switch 18, the lead wheel on the outside rail side of line 16 contacts the contact strip 372 of guard rail structure 172 to energize trigger circuit 166 through lead 350, contact 300, and solenoid coil 262, which shifts the actuation mechanism machine back to the position of FIG. 5 (as indicated by the arrows 490, 492 and 494 of FIG. 6), which thus shifts the switch points 88 and 98 to the position of FIG. 1 in which the switch 18 is set to guide the train from the branch line to the main line.

The throw bar 130 will now have its position changed to bring its contact strip 198 into electrical engagement with contact 210 of the branch line continuity rail structure transfer rail 100, thereby energizing the branch line continuity rail structure 94. The resulting positioning of the cross lever 142 also opens trigger circuit 166 at contact 390 and closes trigger circuit 164 at contact 394, thereby deenergizing solenoid coil 262 for its protecton.

The train thus continues through the switch assembly, and across the continuity rail structure 94, with the same pattern of continuous electrical energy supply that is provided by the continuity rail structure 80, as aforedescribed. The train thus proceeds smoothly through switch assembly 10 onto the main line 14 and to the right of FIG. 1.

Assuming that the train is moving down the main line 14 from the right to the left of FIG. 1, and the switch components are positioned as indicated by the showing of FIG. 6, the push button switch 424 is actuated to energize the solenoid coil 262 that actuates the actuation mechanism and machine 160 to change the position of the throw bars 118 and 130 to the same position, namely that shown in FIG. 1, whereby the train can smoothly proceed through the switch assembly onto the branch line, with the continuity rail structure 94 providing the continuous electrical supply that has been described for movement in that direction.

It will therefore be seen that the invention provides a simplified but effective switch assembly that incorporates both automatic and push button actuation switching, with the automatic switching being for movement of the train in one direction along the track, and the now popular push button switching being for train movement in the opposite direction along the track.

The continuity rail structures that have been provided for the main line and branch line trackage at the switch intersection eliminate the problem of energy interruption as the locomotive and cars cross the track interruptions involved, with the switch assembly at the same time fully coordinating the needed energization of the continuity rail assemblies with the position of the switch points that will be needed for the particular direction of train movement that will be involved. Furthermore, the continuity rail structures provide continuous support thereacross for the smaller pick up rollers 52 of train cars, which pick up rollers frequently will drop between rail sections at rail switch interruptions of conventional switch assemblies, with roller break-off and/or car derailment being a common consequence.

The combination base, track assembly, and actuation mechanism housing arrangement provides a low profile switch assembly structure of minimal area of outline, which at the location of the actuation mechanism or machine avoids interference with passing cars and permits the application of adjacent trackage without interference.

While the illustrated switch assembly is of the right switch type, left switches will be similarly arranged with their wiring being arranged to be of the opposite hand, as will be apparent to those skilled in the art.

The specific arrangement of the actuation mechanism or machine and the push button equipped subassembly permit these parts to be readily assembled and disassembled while at the same time providing for automatically correct position of engagement of the respective contacts involved for unhindered operation of the switch through push button operation. The push button operation, of course, can be employed to shift the switch components to either position, for train movement either to the left or to the right of FIG. 1, as desired.

If desired, switch assembly 10 may be operated entirely manually by moving handle 341 of machine 160 in the appropriate direction by hand. A manually operated version of assembly 10 of simplified structural arrangement is provided by eliminating the trigger circuits, namely circuits 164 and 166, solenoid coils 260 and 262, and the associated electrical parts so that the switching is performed entirely manually. Such simplified arrangement preferably retains the continuity rail structures 80 and 94 and their alternate energization arrangement associated with throw bar 130.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a toy railroad track switch assembly for toy electric railroad trains of the type having a locomotive equipped with an electrical pick up power rail riding rollers, with the train locomotive and cars being equipped with rail engaging wheels for riding on the track, said switch assembly including a flat base, main and branch line track rails merging in track switch relation on the base including outside continuous main and branch line wheel bearing side rails, a wheel bearing frog having a heel and a toe, inside main and branch line wheel bearing side rails merging at the heel of the wheel bearing frog, a main line power rail centered between the main line side rails and interrupted adjacent the frog toe to define interruption end portions, a branch line power rail centered between the branch line side rails and having an end portion merging with the main line power rail, said branch line power rail being interrupted adjacent the frog toe to define interruption end portions, a pair of switch points pivotally mounted at like ends on the base to dispose their other ends in projecting relation from the branch line rails and within the outside rails, with the other ends of said switch points being mounted for movement into and out of switching relation with the respective outside rails, and rail sections secured to the base connecting the frog toe with the respective switch points said one ends through said power rail interruptions, the improvement wherein:

said rail sections each comprise:

a main line center rail continuity rail structure interposed within the main line power rail interruption in overlapping relation with the respective main line power rail interruption end portions, and comprising a first transfer rail aligned with the branch line inside rail and extending between frog toe and said one end of the switch point on the main line outside rail side of the switch assembly, and a guard rail adjacent and electrically connected to said first transfer rail on the gauge side of same, said main line center rail continuity rail structure being electrically insulated from said power rails, and being positioned for continuous electrical power pick up engagement therealong by the power rail riding roller as the train moves across said main line center rail continuity structure and the power rail riding roller rides the main line center rail continuity rail structure along and between the respective main line power rail interruption end portions, a branch line center rail continuity rail structure interposed within the branch line power rail interruption in overlapping relation with the respective branch line power rail interruption end portions, and comprising a second transfer rail aligned with the main line inside rail and extending between the frog toe and said one end of the other switch point, and a guard rail adjacent an electrically connected to said second transfer rail on the gauge side of same, said branch line center rail continuity rail structure being electrically insulated from said power rails and from said main line continuity rail structure, and being positioned for continuous electrical power pick up engagement therealong by the power rail riding roller as the train moves across said branch line center rail continuity rail structure and the power rail riding roller rides the branch line center rail continuity rail structure along and between the respective branch line power rail interruption end portions, said improvement further comprising:

a first guard rail section in the main line on the gauge side of the main line outside rail adjacent the frog and having an electrical contact on the wheel engaging side of same, a second guard rail section in the branch line on the gauge side of the branch line outside rail adjacent the frog and having an electrical contact on the wheel engaging side of same, said guard rail sections being electrically insulated from the main and branch line rails, a pair of spaced apart parallel throw bars mounted on said base, underlying the main line and extending transversely of same, for movement lengthwise of the respective throw bars, one of said throw bars having said other ends of said switch points secured thereto for said mounting of same for effecting said switching relations with the respective outside rails, and the other of said throw bars being disposed under said continuity rail structures, a cross lever extending between said throw bars adjacent to and outside of the main line outside rail and pivotally connected therebetween, said cross lever being pivoted intermediate its ends to the base for pivotal movement about an axis extending normally of the base, said other throw bar including a contact plate movable therewith and electrically connected to one of said power rails and being proportioned lengthwise of said other throw bar to electrically engage said branch line continuity rail structure, to the exclusion of said main line continuity rail structure, when said switch points are disposed for branch line travel, and to electrically engage said main line continuity rail structure, to the exclusion of said branch line continuity rail structure, when said switch points are disposed for main line travel, means for power shifting one of said throw bars longitudinally thereof in opposite directions lengthwise thereof for power shifting both of same through said cross lever between their respective operating positions, said power means comprising electrically operated oppositely acting thrust means including solenoid means for actuating same, with said solenoid means being electrically connected to one of the power rails, each of said guard rails section contacts being electrically connected to said solenoid means by a trigger circuit for separately actuating said power means when a train moves through the switch assembly in a predetermined direction on the branch line to the main line, or in the same direction on the main line, whereby, when a train moves through the main line of the switch assembly in the predetermined direction, the switch points have their said other ends disposed for main line passage of the train through the switch assembly and said main line continuity rail structure is energized for continuous electrical power pick up therealong by the power rail riding roller during such train main line passage through the switch assembly, and when a train moves through the switch assembly branch line to its main line, the switch points have their said other ends disposed for switching of the train to the main line and said branch line continuity rail structure is energized for continuous electrical power pick-up therealong by the power rail riding roller during such branch line to main line passage through the switch assembly.

2. The improvement set forth in claim 1 wherein:

said trigger circuits each include an off-on switch operated by movement of said cross lever on actuation of said power means for discontinuing energization of said solenoid means upon energization of same through the respective trigger circuits.

3. The improvement set forth in claim 1 wherein:

said power shifting means is housed in a low profile planar housing fixed to said base in coplanar relation to said rails and having a height in its said fixed relation that closely approaches that of the top of said rails.

4. The improvement set forth in claim 3 wherein:

said housing is of elongate parallelepiped configuration and is disposed on said base so that its long dimension substantially parallels the main line outside rail.

5. The improvement set forth in claim 4 wherein:

said housing defines an upright end wall having first and second exterior contacts electrically connected to solenoid means for oppositely actuating same and a third exterior contact electrically connected to one of said power rails, and including a subframe removably cantilever mounted on said housing and having a height comparable to that of said housing, said subframe including a first contact in pressure engagement with said first exterior contact, a second contact in pressure engagement with said second exterior contact, and a third contact in pressure engagement with said third exterior contact, said subframe mounting a first push button switch electrically connected with its first contact and a second push button switch electrically connected with its second contact, said switches each being electrically connected to said subframe third contact and one of the side rails for selectively manually actuating said solenoid means separately from energization of said trigger circuits.

6. The improvement set forth in claim 5 wherein:

said subframe and said housing are formed for snap fitting application of said subframe to said housing.

7. In a toy railroad track switch assembly for toy electric railroad trains of the type having a locomotive equipped with an electrical pick up power rail riding roller, with the train locomotive and cars being equipped with rail engaging wheels for riding on the track, said switch assembly including a flat base, main and branch line track rails merging in track switch relation in a predetermined direction on the base including outside continuous main and branch line wheel bearing side rails, a wheel bearing frog having a heel and toe, inside main and branch line wheel bearing side rails merging at the heel of the wheel bearing frog, a main line power rail centered between the main line side rails and interrupted adjacent the frog toe to define interruption end portions, a branch line power rail centered between the branch line side rails and having an end portion merging with the main line power rail, said branch line power rail being interrupted adjacent the frog toe to define interruption end portions, a pair of switch points pivotally mounted at like ends on the base to dispose their other ends in projecting relation from the branch line rails and within the outside rails, with the other ends of said switch points being mounted for movement into and out of switching relation with the respective outside rails, and rail sections secured to the base connecting the frog toe with the respective switch points said one ends through said power rail interruptions, the improvement wherein:

said rail sections each comprise:

a main line center rail continuity rail structure interposed within the main line power rail interruption in overlapping relation with the respective main line power rail interruption end portions and comprising a first transfer rail aligned with the branch line inside rail and extending between frog toe and said one end of the switch point on the main line outside rail side of the switch assembly, and a guard rail adjacent and electrically connected to said first transfer rail on the gauge side of same, said main line center rail continuity rail structure being electrically insulated from said power rails and being positioned for continuous electrical power pick-up engagement therealong by the power rail riding roller as the train moves across said main line center rail continuity structure and the power rail riding roller rides the main line center rail continuity rail structure along and between the respective main line power rail interruption end portions, a branch line center rail continuity rail structure interposed within the branch line power rail interruption in overlapping relation with the respective branch line power rail interruption end portions, and comprising a second transfer rail aligned with the main line inside rail and extending between the frog toe and said one end of the other switch point, and a guard rail adjacent and electrically connected to said second transfer rail on the gauge side of same, said branch line center rail continuity rail structure being electrically insulated from said power rails and from said main line continuity rail structure, and being positioned for continuous electric power pick-up engagement therealong by the power rail riding roller as the train moves across said branch line center rail continuity rail structure, and the power rail riding roller rides the branch line center rail continuity rail structure along and between the respective branch line power rail interruption end portions, said improvement further comprising:

a pair of spaced apart parallel throw bars mounted on said base, underlying the main line and extending transversely of same, for movement lengthwise of the respective throw bars, one of said throw bars having said other ends of said switch points secured thereto for said mounting of same for effecting said switching relations with the respective outside rails, and the other of said throw bars being disposed under said continuity rail structures, a cross lever extending between said throw bars adjacent to and outside of the main line outside rail and pivotally connected therebetween, said cross lever being pivoted intermediate its ends to the base for pivotal movement about an axis extending normally of the base, said other throw bar including a contact plate movable therewith and electrically connected to one of said power rails and being proportioned lengthwise of said other throw bar to electrically engage said branch line continuity rail structure, to the exclusion of said main line continuity rail structure, when said switch points are disposed for branch line travel, and to electrically engage said main line continuity rail structure, to the exclusion of said branch line continuity rail structure, when said switch points are disposed for main line travel, means for shifting one of said throw bars longitudinally thereof in opposite directions lengthwise thereof for power shifting both of same through said cross lever between their respective operating positions, said shifting means comprising oppositely acting mechanical thrust means including means for thrusting said one throw bar in said opposite directions, whereby, when a train moves through the main line of the switch assembly in the predetermined direction, the switch points have their said other ends disposed for main line passage of the train through the switch assembly and said main line continuity rail structure is energized for continuous electrical power pick-up therealong by the power rail riding roller during such train main line passage through the switch assembly, and when a train moves through the switch assembly branch line to its main line, the switch points have their said other ends disposed for switching of the train to the main line and said branch line continuity rail structure is energized for continuous electrical power pick-up by the power rail riding roller during such branch line to main line passage through the switch assembly.

8. The improvement set forth in claim 7 wherein:

said mechanical thrust means is housed in a low profile planar housing fixed to said base in coplanar relation to said rails and having a height in its said fixed relation that closely approaches that of the top of said rails.

9. In a toy railroad track switch assembly for toy electric railroad trains of the type having a locomotive equipped with an electrical pick up power rail riding roller, with the said switch assembly including a flat base, main and branch line track rails merging in track switch relation in a predetermined direction on the base including outside continuous main and branch line wheel bearing side rails, a wheel bearing frog having a heel and toe, inside main and branch line wheel bearing side rails merging at the heel of the wheel bearing frog, a main line power rail centered between the main line side rails and interrupted adjacent the frog toe to define interruption end portions, a branch line power rail centered between the branch line side rails and having an end portion merging with the main line power rail, said branch line power rail being interrupted adjacent the frog toe to define interruption end portions, a pair of switch points pivotally mounted at like ends on the base to dispose their other ends in projecting relation from the branch line rails and within the outside rails, with the other ends of said switch points being mounted for movement into and out of switching relation with the respective outside rails, and rail sections secured to the base connecting the frog toe with the respective switch points said one ends through said power rail interruptions, the improvement wherein:

said rail sections each comprise:

a main line center rail continuity rail structure interposed within the main line power rail interruption in overlapping relation with the respective main line power rail interruption end portions and comprising a first transfer rail aligned with the branch line inside rail and extending between frog toe and said one end of the switch point on the main line outside rail side of the switch assembly, and a guard rail adjacent and electrically connected to said first transfer rail on the gauge side of same, said main line center rail continuity rail structure being electrically insulated from said power rails and being positioned for continuous electrical power pick-up engagement therealong by the power rail riding roller as the train moves across said main line center rail continuity structure and the power rail riding roller rides the main line center rail continuity rail structure along and between the respective main line power rail interruption end portions, a branch line center rail continuity rail structure interposed within the branch line power rail interruption in overlapping relation with the respective branch line power rail interruption end portions, and comprising a second transfer rail aligned with the main line inside rail and extending between the frog toe and said one end of the other switch point, and a guard rail adjacent and electrically connected to said second transfer rail on the gauge side of same, said branch line center rail continuity rail structure being electrically insulated from said power rails and from said main line continuity rail structure, and being positioned for continuous electric power pick-up engagement therealong by the power rail riding roller as the train moves across said branch line center rail continuity rail structure, and the power rail riding roller rides the branch line center rail continuity rail structure along and between the respective branch line power rail interruption end portions, said improvement further comprising:

a throw bar mounted on said base, underlying the main line and extending transversely of same, for movement lengthwise of said throw bar, said throw bar having said other ends of said switch points secured thereto for said mounting of same for effecting said switching relations with the respective outside rails, a cross lever adjacent to and outside of the main line outside rail and extending generally longitudinally of the main line, said cross lever being pivoted intermediate its ends to the base for pivotal movement about an axis extending normally of the base, said cross lever having one of its ends pivotally connected to said throw bar and being disposed such that its other end extends generally in the direction opposite said predetermined direction from said throw bar, said cross lever including on opposite sides of said axis off-on electrical contact means to, in a first position of said cross lever, electrically connect said branch line continuity rail structure with a power rail, to the exclusion of said main line continuity rail structure, when said switch points are disposed for branch line travel, and to in a second position of said cross lever electrically connect said main line continuity rail structure with a power rail, to the exclusion of said branch line continuity rail structure, when said switch points are disposed for main line travel, and means for shifting said throw bar longitudinally thereof in opposite directions lengthwise thereof for pivoting said cross lever between its said first and second positions, said shifting means comprising oppositely acting mechanical thrust means including means for thrusting said throw bar in said opposite directions, whereby, when a train is to move through the main line of the switch assembly, said shifting means may be actuated such that the switch points have their said other ends disposed for main line passage of the train through the switch assembly and said main line continuity rail structure is energized for continuous electrical power pick-up therealong by the power rail riding roller during such train main line passage through the switch assembly, and when a train is to move through the switch assembly between its main line and branch line, said shifting means may be actuated such that the switch points have their said other ends disposed for corresponding passage of the train through the switch assembly and said branch line continuity rail structure is energized for continuous electrical power pick-up by the power rail riding roller during such passage between the branch line and the main line passage through the switch assembly.

10. The improvement set forth in claim 9 wherein:

said shifting means is housed in a low profile planar housing fixed to said base in coplanar relation to said rails and having a height in its said fixed relation that closely approaches that of the top of said rails.

11. The improvement set forth in claim 10 wherein:

said thrust means is electrically power operated.

12. The improvement set forth in claim 10 wherein:

said housing is of elongate parallelepiped configuration and is disposed on said base so that its long dimension substantially parallels the main line outside rail.

13. The improvement set forth in claim 12 wherein:

said housing defines an upright end wall having first and second exterior contacts electrically connected to solenoid means for oppositely actuating same and a third exterior contact electrically connected to one of said power rails, and including a subframe removably cantilever mounted on said housing and having a height comparable to that of said housing, said subframe including a first contact in pressure engagement with said first exterior contact, a second contact in pressure engagement with said second exterior contact, and a third contact in pressure engagement with said third exterior contact, said subframe mounting a first push button switch electrically connected with its first contact and a second push button switch electrically connected with its second contact, said switches each being electrically connected to said subframe third contact and one of the side rails for selectively manually actuating said solenoid means separately from energization of said trigger circuits.

14. The improvement set forth in claim 13 wherein:

said subframe and said housing are formed for snap fitting application of said subframe to said housing.

* * * * *